United States Patent [19]

Loveless

[11] 4,105,356

[45] Aug. 8, 1978

[54] VIBRATORY ROLLER

[75] Inventor: Houston Lee Loveless, Springfield, Ohio

[73] Assignee: Koehring Corporation, Milwaukee, Wis.

[21] Appl. No.: 798,310

[22] Filed: May 19, 1977

[51] Int. Cl.[2] ..... E01C 19/38

[52] U.S. Cl. ..... 404/117

[58] Field of Search ..... 404/102, 103, 117, 133; 172/40; 74/61, 87

[56] References Cited

U.S. PATENT DOCUMENTS

| | | | |
|---|---|---|---|
| 3,606,796 | 9/1971 | Pappers | 74/87 |
| 3,814,532 | 6/1974 | Barrett et al. | 404/117 |
| 3,888,600 | 6/1975 | Vural | 404/117 |
| 3,966,344 | 6/1976 | Haker et al. | 404/117 |

*Primary Examiner*—Henry S. Jaudon

*Attorney, Agent, or Firm*—Burns, Doane, Swecker & Mathis

[57] ABSTRACT

A vibratory roller is disclosed having an improved amplitude control device giving infinitely variable vibration amplitude which can be both increased and decreased. The roller includes a roll having a coaxial shaft driven at an angular velocity exceeding that of the roll. The rotary shaft has a transversely mounted cylinder within which an eccentric mass is slidably mounted for movement between physical constraints which limit the radially innermost position and the radially outermost position. The eccentric mass and cylinder define a piston cylinder arrangement having a control chamber which communicates with an actuating assembly that regulates radial position of the eccentric mass. The actuating assembly may include a pilot operated check valve and a valve assembly to govern communication between both a pressurized fluid source and a fluid reservoir with one side of an actuating motor piston. An indicator device is connected to the motor piston to indicate the precise location of the eccentric mass between its radially innermost and radially outermost positions. With a comparatively wide roll, a second transversely mounted cylinder and corresponding eccentric mass may be provided and arranged to operate simultaneously with the first cylinder and eccentric mass combinations.

7 Claims, 3 Drawing Figures

VIBRATORY ROLLER

BACKGROUND OF THE INVENTION

This invention relates generally to rollers employed for compaction of loose material. More particularly, this invention concerns a roller having a variable amplitude vibrator.

In the past, rollers have been provided with vibrators which include a shaft having a variable position eccentric mass. In most known devices, the variable position eccentric mass may be located at two or more discrete radial positions. Generally, movement between the discrete positions can be effected only while the roller and vibrator are stopped.

Vibratory rollers of the type just described have proved to be of limited utility. For example, with discrete predetermined positions of the eccentric mass, the eccentric mass cannot be positioned intermediate the predetermined positions. Such intermediate positions are desirable when one position provides a vibration amplitude which is too great and the next adjacent position provides a vibration amplitude which is too small. These problems can occur when the vibrating roller is used to compact surface materials having different textures or having the same texture at different sites.

Another disadvantage of the known rollers is the inability to effect adjustments between the predetermined positions of the eccentric mass while the shaft carrying the eccentric mass rotates. While one known device is capable of allowing adjustment in one direction only from a maximum amplitude vibration to a minimum amplitude vibration (see U.S. Pat. No. 3,814,532), the device is basically provided with two discrete operating positions. There is no mechanism for reversing the direction of amplitude adjustment if necessary.

When compacting a material, it is often necessary to move the roller from a compacted surface region which has been treated and in which the roller has a low amplitude vibration to a different contiguous area in which the material has not yet been compacted and in which a large vibration amplitude is necessary. It is therefore desirable to be able to adjust the amplitude of vibration during operation of the machine without needing to stop the machine. Unfortunately, the known devices are not capable of providing this adjustability.

In the one known attempt to provide adjustability of vibration amplitude, a control rod is mounted to reciprocate a rotary piston carried by the shaft. Movement of the piston axially along the shaft varies, hydraulically, the position of the eccentric mass which is biased by a spring (see U.S. Pat. No. 3,059,483). Such a device, however, is limited in its usefulness since the shaft must be rotated at a frequency sufficiently low that centrifugal force of the piston does not exceed the frictional force which positions the control rod and the adjustable piston.

Other attempts at providing adjustability of the eccentric mass require the provision of one or more additional hydraulic pumps or motors in the roller which increase cost and complexity of the roller.

Another common deficiency of the known prior art resides in the inability to precisely duplicate the amplitude of the compacting vibrations at different times during operation of the roller. For example, when a portion of a surface has been finished with a vibration amplitude intermediate the maximum and minimum values and the amplitude of vibration is adjusted to another value to begin coarse compaction of a new portion of the surface, it is highly desirable to finish off the new surface portion. Thus, with an adjustable amplitude vibrator, having no discrete positions, it is highly desirable to provide means for duplicating the amplitude vibration at different times during machine operation.

In view of the foregoing, it will be apparent that the need continues to exist after a vibratory roller which is capable of infinite variations of the vibration amplitude and which is capable of duplicating a selected vibration amplitude at different times.

SUMMARY OF THE INVENTION

A vibratory roller which overcomes the problems of the type discussed above preferably includes an infinitely variable amplitude eccentric mass which is capable of increasing and decreasing the vibration amplitude during operation and which is capable of readjustment to a specific vibration amplitude at spaced apart time periods. Such a roller preferably includes a cylinder means mounted transversely of a vibrator shaft. The cylinder means has an eccentric mass slidably mounted therein so that the mass is urged toward the axis by hydraulic fluid. With this construction, the eccentric mass and the cylinder require the fewest number of seals and therefore the expense thereof is reduced.

In addition, the roller includes a motor means which hydraulically positions the eccentric mass relative to the axis of shaft rotation. The motor means preferably uses hydraulic fluid from a pump supplying hydraulic power to the remaining portions of the roller and therefore eliminates additional hydraulic equipment.

An indicator means is connected to the motor means and is accessible to the machine operator to provide an indication of the vibration amplitude during operation. In addition, the indicator means provides a mechanism whereby the machine operator can return to a predetermined amplitude when the vibrating mass has been displaced from the desired amplitude for one purpose or another.

The motor means is powered by pressurized fluid from the roller hydraulic system and is, therefore, capable of adjusting the position of the eccentric mass relative to the cylinder means while the cylinder and eccentric mass are rotating. Since the motor means is powered, adjustment may either increase amplitude or decrease amplitude of vibration. The cylinder means containing the eccentric mass is provided with a mechanical stop to prevent the mass from becoming located such that the center of the eccentric mass is coincident with the axis of rotation at any time.

Preferably, the motor means may include a piston of an hydraulic cylinder having two chambers. One chamber communicates with a control chamber positioned between the eccentric mass and the hydraulic cylinder means whereas the second chamber communicates with the roller hydraulic system. A suitable conventional pilot operated check valve and a control valve regulate the communication between the second chamber and a pressurized source and reservoir of the roller hydraulic system.

When the roll is comparatively wide, a pair of cylinder means may be mounted transversely of the vibrator shaft at axially spaced locations. In this manner deflection of the vibrator shaft can be substantially reduced.

BRIEF DESCRIPTION OF THE DRAWINGS

Many objects of the present invention will be apparent to those skilled in the art when this specification is read in conjunction with the drawings wherein like reference numerals have been applied to like elements and wherein.

DESCRIPTION OF THE PREFERRED EMBODIMENTS

Figure 1:
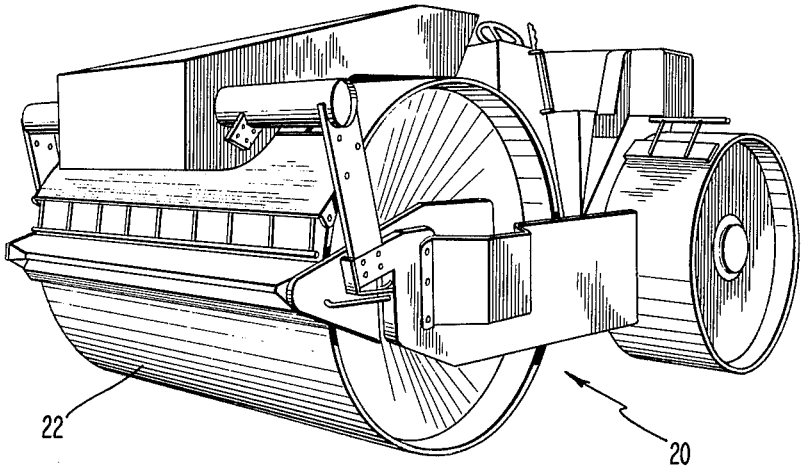
FIG. 1 is a pictorial view of a vibratory roller.
Figure 1:
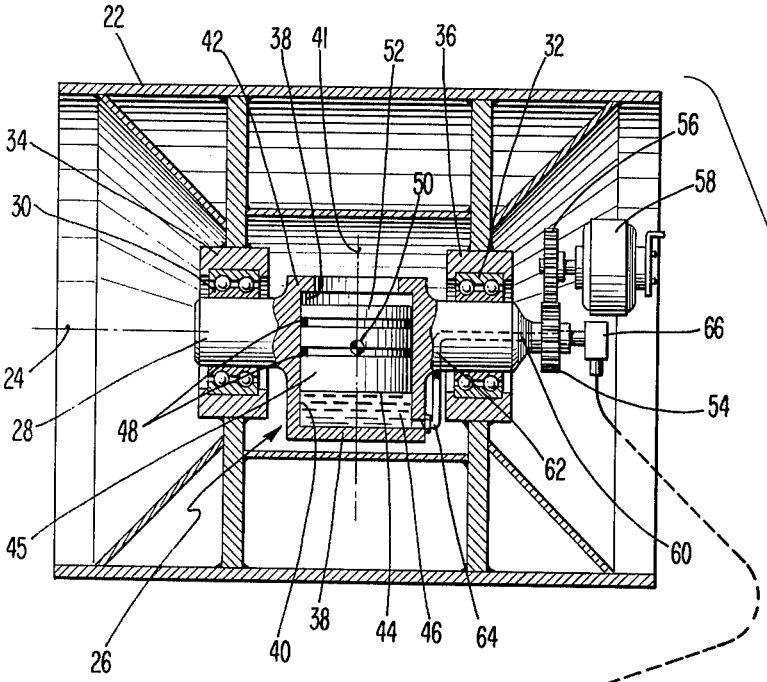

A vibratory roller 20 (see FIG. 1) typically includes one or more generally cylindrical rolls 22 each of which revolves around a horizontal axis 24 as the roller is driven to compact material underlying the roller 20. The present invention relates, in particular, to an improved vibrator for use within the roll 22. In this connection, it will be apparent that, if two or more rolls are provided on the roller 20, the improved vibrator may be provided in each roller or in at least one roll but less than all of the rolls.

The improved vibrator 26 (see FIG. 2) includes a shaft 28 which is coaxially mounted relative to the horizontal axis 24 of rotation of the roll 22. A suitable conventional bearing 30, 32 may be provided at each end of the shaft 28 to rotatably mount the shaft 28 with respect to suitable conventional supports 34, 36, respectively, of the roll 22.

The shaft 28 includes an hydraulic cylinder means 38 which is mounted transversely of the axis 24. As illustrated, the cylinder means 38 may be integral with the shaft 28. The cylinder means 38 includes a generally cylindrical internal surface 40 having a circular cross section. The surface 40 extends generally perpendicularly from the axis 24 and has an axis 41 that intersects the shaft axis 28. In addition, one end of the cylinder means 38 is open to atmospheric pressure and is provided with abutments 42 at one end.

Slidably mounted within the cylinder means 38 is a circularly cylindrical eccentric mass 44 or piston which cooperates with the cylinder means 38 to define a control chamber 46. With a circularly cylindrical configuration, the potential for motion retarding binding between the eccentric mass 44 and the cylinder means 38 is minimized. The cylindrical surface 45 of the eccentric mass 44 has one or more suitable conventional seals 48 which extend circumferentially therearound. The seals 48 hydraulically isolate the control chamber 46 from atmosphere by essentially preventing passage of hydraulic fluid between the surface 45 and the cylindrical surface 40.

The center of mass 50 of the eccentric mass 44 is constrained to be eccentric of the axis of rotation 24 by the abutments 42. More specifically, the abutments 42 engage an end face 52 of the eccentric mass 44 so that the center of mass 50 is always located on a radial line extending outwardly from the axis 24 and passing through the control chamber 46. In this manner, centrifugal force acting on the eccentric mass 44 will always urge the eccentric mass 44 radially outwardly toward the control chamber 46. Moveover, it is impossible for the eccentric mass 44 to develop a centrifugal force which is not opposed by fluid in the control chamber 46. The abutments 42 also define the minimum eccentricity position of the eccentric mass 44.

An end of the shaft 28 extends beyond the second bearing 32 and has a suitable conventional gear 54 attached thereto so as to prevent relative rotation therebetween. A driving gear 56 meshes with the driven gear 54 and is, in turn, driven by a suitable conventional hydraulic motor 58. The hydraulic motor 58 may be attached to a portion of the roller frame (not shown) in a conventional manner.

The protruding end of the shaft 28 has a channel 60 coaxial with the axis 24 and extending through the shaft to a position adjacent the cylindrical surface 40 of the cylinder means 38. The coaxial channel 60 communicates with an intersecting, radially extending channel 62. The radial channel 62 communicates with the radially outermost portion of the control chamber 46. The channels 60, 62 and the L-shaped conduit 64 provide fluid communication between the end of the shaft 28 and the control chamber 26 and define a passage through which hydraulic fluid can enter and leave the control chamber.

Disposed at the protruding end of the shaft 28 is a suitable conventional rotary coupling 66 which provides fluid communication between the channel 60 and a conduit 68 while permitting relative rotation therebetween. The conduit 68 extends from the rotary coupling 66 to a console at the operator's station of the vibratory roller. At the console, the line 68 communicates with a motor means 70. The motor means 70 may, for example, comprise a piston 74 reciprocably mounted indicating cylinder 72. The piston is connected to a piston rod 76 which extends from one end of the cylinder.

The cylinder 72 and the piston 74 cooperate to define a first, generally cylindrical, variable volume chamber 78; and the cylinder 72, the piston 74 and the rod 76 define a second, generally annular, variable volume chamber 80 which is spaced from the first chamber by the piston 74. The first chamber 78, the conduit 68, the channels 60, 62, the L-shaped conduit 64 and the control chamber 46 comprise a closed fluid system within which essentially incompressible hydraulic fluid is contained. Movement of the positioning piston 74 causes fluid movement between the first chamber 78 and the control chamber 46; contraction of the first chamber 78 causes an equal volume increase in the control chamber 46; similarly expansion causes an equal volume decrease. As control chamber volume changes are effected by movement of the eccentric mass 44, position of the piston 74 regulates movement of the eccentric mass 44.

In order to move the piston 74 to the left, pressurized hydraulic fluid is admitted to the annular chamber 80 thereby decreasing the first chamber 78. In order to move the piston 74 to the right, either the weight of the eccentric mass 44 will cause fluid to move from the control chamber 46 and enlarge the first chamber 78. The fluid in the annular chamber 80 of the motor means 70 is trapped therein by a pilot check valve 90 and, therefore, prevents the movement of the eccentric mass 44 radially outwardly away from the axis 24 during machine operation.

Since the volume of hydraulic fluid in the control chamber 46, the first chamber 78 and the fluid passages establishing communication therebetween is constant, volumetric changes in the first chamber 78 and the control chamber 46 can only occur by linear displacement of the positioning piston 74 and the mass 44, respectively. Accordingly, the positioning of the positioning piston 74 is proportional to the position of the eccentric mass 44.

It will be observed that maximum volume of the first chamber 78 must be at least as large as the maximum volume of the control chamber 46, which occurs when the eccentric mass 44 contacts the abutments 42. This volumetric relationship is necessary to permit movement of the eccentric mass between its radially innermost and radially outermost positions.

In order to indicate the position of the eccentric mass 44 with respect to its maximum and minimum amplitude positions, the motor means 70 is provided with an indicator means 82. The indicator means may comprise a pointer 84 extending laterally from the piston rod 76 to provide a readout on a linear scale 86. The scale 86 is attached to the roller at the operator's station and may be graduated to provide convenient reference indicia. In this manner, if it is necesssary to reposition the eccentric mass 44 to give a specific vibration amplitude, the piston 72 need only be positioned until the pointer 84 is aligned with the corresponding indicium or location of the scale 86. Thus, repitition of a predetermined vibration amplitude may be readily effected at any time during operation of the roller.

Those skilled in the art will appreciate that force exerted by the vibrator is a function of the mass of the eccentric mass 44 as well as of the square of shaft angular velocity. By adjusting the speed of the hydraulic motor 58, shaft angular velocity is proportionately changed due to the driving relationship therebetween. Thus, the force of vibration in the present invention can be varied in two ways; linearly by positioning the eccentric mass 44 and quadratically by adjusting the operating speed of the hydraulic motor 58.

In order to provide powered movement of the positioning piston 74 and the actuating means to the left, the annular chamber 80 communicates with a conduit 88 which leads to the pilot operated check valve 90. Suitable conventional conduits 92 connect the pilot operated check valve with a suitable conventional manually operated four-way, three-position spring centered control valve 94. The control valve 94 communicates with a source 96 of pressurized hydraulic fluid on the roller and with the reservoir 98 of hydraulic fluid on the roller. The first position A of the control valve 94 permits fluid to flow directly from the pressurized source to the check valve 90 and into the annular chamber 80. In the second position B, the control valve 94 permits pressurized fluid from the source to open the pilot operated check valve 90 and establish communication between the annular chamber 80, through the pilot operated check valve 90 and the control valve 94, to the tank 98.

Preferably, the source 96 provides hydraulic fluid at a pressure of about 1000 psig with a flow rate of about 5 gallons per minute. By using the comparatively low hydraulic pressure, the cost of hydraulic equipment is minimized since higher pressures require more sophisticated seals and manufacturing tolerances. The flow rate of 5 gallons per minute provides an acceptable response time for amplitude adjustments.

Figure 2:
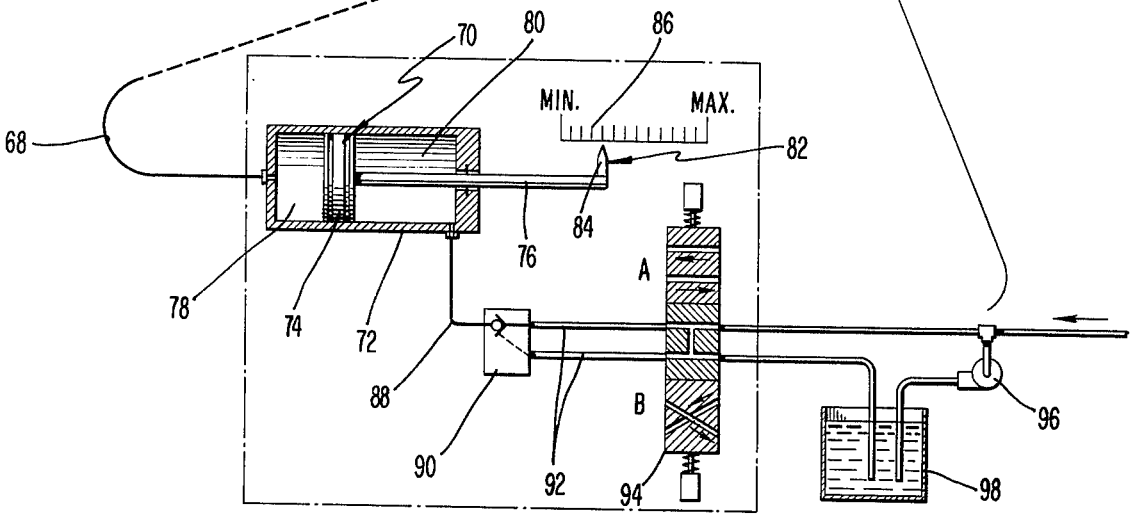
FIG. 2 is a schematic illustration of the improved vibrating means along with its control system.
Figure 3:
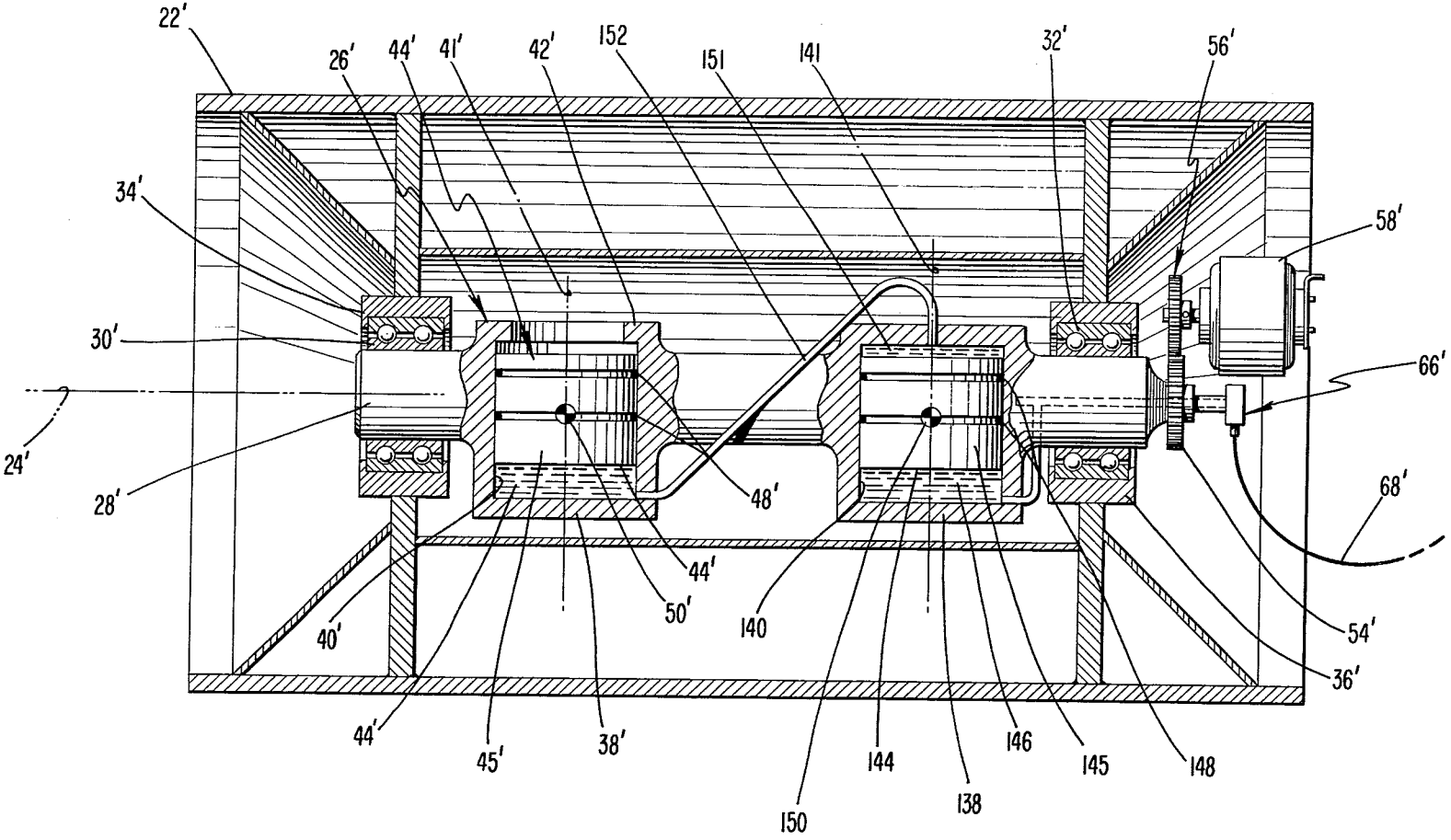
FIG. 3 is a schematic illustration of a vibrating means having two eccentric masses.

An alternate embodiment of the present invention is particularly well suited for rollers in which the roll is comparatively wide. A wide roll is illustrated in FIG. 3 with elements corresponding to elements of FIG. 2 having the same reference numeral applied thereto and differentiated by the addition of a superscript (′). The following description relates only to the differences between the embodiment of FIG. 3 and the embodiment of FIG. 2; it is understood that the description herein relating to elements of FIG. 2 is equally applicable to the corresponding elements of FIG. 3.

The shaft 28′ (see FIG. 3) includes two cylinders 38′, 138, each having a corresponding axis 41′, 141, disposed transversely of the shaft axis 24′ and preferably perpendicular thereto. The axes 41′, 141 are axially spaced apart along the shaft axis 24′ and may be equally spaced from the corresponding adjacent shaft bearing 30′, 32′. This location of the shaft axes 41′, 141, permits deflection of the shaft 28′ to be reduced in comparison to deflection of a shaft having a single eccentric mass of the same weight as the combined weight of eccentric masses 44′, 144.

Preferably, the second eccentric mass 144 is identical in all respects with the first eccentric mass 44′. In this connection, the second eccentric mass 144 includes a cylindrical surface 145 with circumferential seals 148 and a center of mass 150.

In the same vein, the second cylinder 138 is substantially the same as the first cylinder 38′ except for the opening to atmospheric pressure. The second cylinder 138 includes a generally cylindrical surface 140 and cooperates with the eccentric mass 44 to define a second control chamber 146. The second cylinder 138, in distinction to the first cylinder 38′, also includes a second closed chamber 151 which is separated from the second control chamber 146 by the eccentric mass 144 and hydraulically sealed therefrom by the circumferential seals 148.

The second closed chamber 151 communicates with the control chamber 46′ of the first cylinder 38′ via a conduit 152 extending therebetween. The conduit 152, the second closed chamber 151 and the first control chamber 46′ are filled with hydraulic fluid and define a constant fluid volume.

Hydraulic fluid is admitted to the second control chamber 146 from the rotary coupling 66′ through channels 60′, 62′, 64′. The hydraulic fluid thus supplied is regulated by the motor means 70 in the same manner as described in connection with the control chamber 46 of FIG. 2.

In operation, the hydraulic motor 58 (see FIG. 2) is driven at a preselected rotational speed to cause rotation of the shaft 28 relative to the roll 22 at a desired angular velocity. The shaft 28 may, for example, be rotated with an angular velocity in the range of 1500 to 4000 rpm. The 4000 rpm value would preferably be used on relatively small rollers.

With the shaft 28 rotating at a suitable angular velocity, centrifugal force is exerted on the eccentric mass 44 urging the eccentric mass 44 radially outwardly away from the center line 24. Typically, the eccentric mass may have a weight of about 30 lbs. The tendency of the eccentric mass 44 to move radially outwardly away from the center line 24 is resisted by the presence of hydraulic fluid in the control chamber 46. The volume of the control chamber 46 is held constant by fixing the location of the positioning piston 74 in the motor means. The check valve 90 prevents the flow of hydraulic fluid from the annular chamber 80 unless the pilot operated check valve has been released by suitable manipulation of the control valve 94. As a result, centrifugal force on the eccentric mass 44 causes hydraulic pressure in the control chamber 46, the cylindrical chamber 78 and the annular chamber 80.

At this point, it will be appreciated that the weight of the eccentric mass, acting alone, is sufficient to cause movement of the positioning piston when the check valve 90 is open. The basic difference between operation of the amplitude adjustment with and without centrifugal force resides in the rate at which adjustments increasing amplitude occur; faster when centrifugal force is applied; slower when centrifugal force is absent.

Should it be desired to increase the amplitude of the vibration induced by the eccentric mass 44 while the shaft 28 is rotating, the control valve 94 is manually positioned at its second position B. In the second position, the source 96 of hydraulic fluid is connected to the pilot port of the check valve 90 to release the check valve. Then, hydraulic fluid, pressurized by the eccentric mass 44, passes from the annular chamber 80 through the conduit 88, the check valve 90, the conduit 92, and into the tank 98 causing the annular chamber 80 to contract. The volumetric decrease in the annular variable volume chamber 80 provides a proportional increase in the volume of the cylindrical variable volume chamber 78. Accordingly, there is a proportional decrease in the volume of the variable control chamber 46 so that the eccentric mass 44 can move radially outwardly under the influence of the centrifugal force.

As the piston moves radially outwardly, the positioning piston 74 moves to the right in the positioning cylinder 72 as a result of the changing volumes of the adjacent chambers 78, 80. Movement of the positioning piston 74 causes the pointer 84 to indicate a new position on the scale 86. When the control valve is returned to its neutral position, the radial movement of the eccentric mass 44 ceases and its position is identified on the scale 86 by the pointer 84.

Should it be desired to decrease the amplitude of vibration at any time, the control valve 94 is shifted to its first position A so that pressurized hydraulic fluid from the source 96 is connected through the check valve 90 to the second variable volume chamber 80. The pressure of fluid in the chamber 80 increases volume thereof and causes the piston 74 to move to the left. Movement of the piston decreases the volume of the first chamber 89, shifts fluid to the control chamber 46 and increases the volume of the control chamber 46. As the control chamber 46 increases in volume, hydraulic pressure forces the eccentric mass 44 radially inwardly against the centrifugal force developed by the eccentric mass 44 so that the amplitude of vibration is decreased.

The operation of the embodiment of FIG. 3 is closely analogous to the embodiment of FIG. 2. The difference being that as hydraulic fluid enters the second control chamber 146, the eccentric mass 144 is displaced causing a corresponding decrease in the volume of the second closed chamber 151. Hydraulic fluid from the closed chamber 151 then passes through the conduit 152 and into the control chamber 46' thus displacing the first eccentric mass 44'. With the eccentric masses 44', 144 having the same diameter, and with a constant volume of hydraulic fluid connecting the control chamber 46' and the closed chamber 151, movement of the second eccentric mass 144 results in an identical movement of the first eccentric mass 44'.

It will be apparent to those skilled in the art that, if desired, more than two eccentric masses 44 may be employed on a single rotating shaft 28. In this event a cylinder would be provided for each eccentric mass. The plurality of cylinders could be interconnected for simultaneous operation, as in the second embodiment, or could each be independently actuated by a motor means, as in the first embodiment.

The control of the present invention permits infinite variation of the vibration amplitude by the eccentric mass between maximum and minimum eccentricity positons. And, the control is operative whether amplitude is to be increased or decreased and is effective whether the vibrator is operating or not.

In addition, the vibratory roller of the present invention permits repositioning of the eccentric mass and vibration amplitude to a predeteremined location, which may have been previously used, merely by resetting the indicator means.

Still further, the amplitude of vibration can be both increased and decreased while the eccentric mass 44 is rotating.

Another advantage of the present invention resides in the use of relatively low pressure hydraulic fluids which permits the use of inexpensive components in the system.

It should now be apparent to those skilled in the art that there has been provided in accordance with this invention, an improved vibratory roller. Moreover, it will be apparent to those skilled in the art that numerous modifications, variations, substitutions and equivalents exist for features of the invention without departing from the spirit and scope thereof. Accordingly, it is expressly intended that all such modifications, variations, substitutions and equivalents which fall within the spirit and scope of the invention as defined in the appended claims be embraced thereby.

What is claimed is:

1. In vibratory compacting roller apparatus of the type having a compacting roll rotatable about a generally horizontal axis, shaft means rotatable about said axis at a speed independent of that of said roll, and an eccentric mass rotatable with said shaft means to develop forces for vibrating said roll, said eccentric mass being movable transversely of said shaft means to different positions relative to said axis to provide variable amplitude for vibrations induced thereby, the improvement comprising:

cylinder means rotatable with said shaft means and having a chamber therein for receiving said eccentric mass, said chamber being shaped to permit movement of said eccentric mass radially of said axis from an innermost limit to an outermost limit;

means for conducting fluid to or from an end portion of said chamber to increase or decrease the eccentricity of said eccentric mass during rotation of said shaft means;

motor means connected to said means for conducting fluid such that a constant volume of fluid is located between said eccentric mass and said motor means and so that a change in position of said motor means will be accompanied by a change in radial position of said eccentric mass; and indicator means connected with the motor means and operable to provide a representation of the position of the eccentric mass between the maximum and minimum eccentricity positions thereof.

2. The roller of claim 1, wherein the motor means includes a piston separating a first variable volume chamber and a second variable volume chamber, the first chamber communicating with the cylinder means, volumetric change of the second chamber being proportional to volumetric change of the first chamber, volumetric change of the first chamber being proportional to volumetric change of said cylinder means chamber, and the second chamber being operable to receive pressurized fluid and thereby cause a proportional increase in the volume of said cylinder means chamber.

3. The roller of claim 2, wherein:

a scale is connected to the roller at the control station;

the piston includes a piston rod extending outwardly therefrom; and the indicator means includes a pointer connected to the piston rod which cooperates with the scale to signify position of the eccentric mass between the maximum and minimum radial positions.

4. The roller of claim 2, wherein said cylinder means chamber is positioned radially beyond the eccentric mass so as to regulate radial flight of the eccentric mass from the horizontal axis during rotation.

5. The roller of claim 4, further including:

a source of pressurized fluid;

a fluid reservoir;

a pilot operated check valve which communicates with and regulates the flow of fluid from the second chamber; and control valve means communicating with the pilot operated check valve, the source of pressurized fluid and the fluid reservoir, being operable to establish communication between the source and the second chamber to enlarge said cylinder means chamber so as to decrease vibration amplitude, and being operable to establish fluid communication between the second chamber and the reservoir to permit said cylinder means chamber volume to decrease under the influence of the eccentric mass so as to increase vibration amplitude.

6. The roller of claim 1, wherein the cylinder means includes an abutment which prevents the center of mass of the eccentric mass from crossing the horizontal axis.

7. In vibratory compacting roller apparatus of the type having a compacting roll about a generally horizontal axis, shaft means rotatable about said axis at a speed independent of that of said roll, and an eccentric mass rotatable with said shaft means to develop forces for vibrating said roll, said eccentric mass being movable to different positions relative to said axis to provide variable amplitude for vibrations induced thereby, the improvement comprising:

cylinder means rotatable with said shaft means and having a chamber therein for receiving said eccentric mass, said chamber being shaped to permit movement of said eccentric mass radially of said axis from an innermost limit to an outermost limit;

means for conducting fluid to or from an end portion of said chamber to increase or decrease the eccentricity of said eccentric mass during rotation of said shaft means;

motor means remote from shaft means and connected to said means for conducting fluid such that a constant volume of fluid is located between said eccentric mass and said motor means and so that a change in position of said motor means will be accompanied by a change in radial position of said eccentric mass.

* * * * *